United States Patent [19]

Sawai et al.

[11] Patent Number: 4,938,719

[45] Date of Patent: Jul. 3, 1990

[54] JUNCTION BLOCK

[75] Inventors: Mamoru Sawai; Keiichi Ozaki, both of Kosai, Japan

[73] Assignee: Yazaki Corporation, Tokyo, Japan

[21] Appl. No.: 288,067

[22] Filed: Dec. 22, 1988

[30] Foreign Application Priority Data

Dec. 28, 1987 [JP] Japan ..... 62-329843

[51] Int. Cl.[5] ..... H01R 9/22

[52] U.S. Cl. ..... 439/714; 439/696; 439/404; 439/724

[58] Field of Search ..... 439/709, 712, 714, 715, 439/719, 724, 696, 701, 687, 688, 284, 289, 290, 291, 395–407

[56] References Cited

U.S. PATENT DOCUMENTS

| | | | |
|---|---|---|---|
| 2,750,572 | 6/1956 | Fox | 439/687 |
| 3,717,840 | 2/1973 | Vaughan et al. | 439/714 |
| 4,162,815 | 7/1979 | Fleischhacker | 439/290 |
| 4,508,403 | 4/1985 | Weltman et al. | 439/502 |
| 4,552,429 | 11/1985 | van Alst | 439/404 |

FOREIGN PATENT DOCUMENTS 61-45575 3/1986 Japan .

*Primary Examiner*—David Pirlot

*Attorney, Agent, or Firm*—Armstrong, Nikaido, Marmelstein, Kubovcik & Murray

[57] ABSTRACT

A junction block comprises a pair of first and second cover cases each having an inner surface and an outer surface, the inner surface grooves therein; a plurality of electrical conductors each having a first portion, a second portion, and a middle portion therebetween, the first portion being received in a groove of the first cover case and the second portion being received in a groove of the second cover case; contact-terminals inserted into the cover cases through the grooves to protrude through the outer surfaces of the first and second cover cases for electrical connection with external circuits as well as the conductors; the first cover case being piled on the second cover case such that the respective inner surfaces face each other; and insulating partitioning means sandwiched between the first and second cover cases.

3 Claims, 9 Drawing Sheets

JUNCTION BLOCK

BACKGROUND OF THE INVENTION

1. Field of the Invention

The present invention relates to a junction block for branching away and connecting together wires which form a wire harness.

2. Description of Prior Art

A junction block as shown in FIG. 6 have been conventionally used for branching away and connecting together wires which form a wire harness. With this type of junction blocks, bus bars 2, 2', 2" are sandwiched between an upper case 1 and a lower case 4. Each of the bus bars is stacked in multi-layers with insulating substrates 3, 3' . . . inserted therebetween, having a plurality of electrically conductive tabs (male contacts) 2a, 2a', 2a". The tabs 2a, 2a', 2a" protrude into a connector-receiving portion 5, formed on the upper case 1 or on the lower case 4, for electrical connection with external wires or circuits through a connector, which is to be inserted into the portion 5. A relay terminal 6 is a female-female type relay terminal for connecting conductors through U-links as shown in FIG. 9.

FIG. 7 illustrates an electrical equivalent circuit of the bus bars in the junction block described above, in which one circuit (bus bar) is used for providing four tabs a, b, c, and d.

In order to provide branch circuits and the tabs at predetermined positions on the junction block using the bus bars, it is necessary to allow the tabs 2a, 2a', to protrude upwardly or downwardly at different locations on the bus bars as shown in FIG. 6. However, arranging tabs on different bus bars into individual groups causes design problems such as difficulty in routing bus bars and interferences from other bus bars, leading to a long assembly time. In the mean time, Japanese Patent KOKAI publication No. 61-435575 discloses a technique of high density construction of a junction circuit as shown in FIG. 8. A group of specific wires 7 that branch away from a wire harness W are disposed in parallel to each other, and are sandwiched between an upper case 8 and a lower case 9. The wires 7 are pressed into slots 12 of friction contact portions 11 of friction contact terminals 10. Male type contacts 13 on the side opposite to the friction contact portions 11 protrude into female-connector receiving portions 14 formed on the upper case 8. Connectors 15 on which other wires 7' that branch away from the wire harness W are assembled, are inserted into the portions 14 of the upper case 8, thus electrically interconnecting the wires 7 and 7'.

However, this type of junction blocks suffer from disadvantages that the friction contact terminals 10 can be mounted only on one side of the upper case 12; therefore grouping up of the male contacts 13 is rather difficult because of limited locations of the portions 14 and the number thereof. Also, the wires from the wire harness W are directly assembled in the junction block; therefore the harness wire cannot be assembled independently of conductors in the junction block, causing complexity of assembly process.

SUMMARY OF THE INVENTION

The present invention was made to overcome the aforementioned drawbacks and is to provide a junction block which permits higher density of branch circuits and flexible grouping of contacts or tabs in accordance with the external circuit, thereby facilitating production.

A junction block according to the present invention comprises a pair of first and second cover cases each having an inner surface and an outer surface, the inner surface having grooves therein; a plurality of electrical conductors each having a first portion, a second portion, and a middle portion therebetween, the first portion being received in a groove of the first cover case and the second portion being received in a groove of the second cover case; contact-terminals inserted into the cover cases through the grooves to protrude through the outer surfaces of the first and second cover cases for electrical connection with external circuits as well as the conductors; the first cover case being piled on the second cover case such that the respective inner surfaces face each other; and insulating partitioning means sandwiched between the first and second cover cases.

BRIEF DESCRIPTION OF THE DRAWINGS

The above and other objects and advantages will be apparent from the following description of specific embodiments with reference to the accompanying drawings, in which.

DETAILED DESCRIPTION OF THE PREFERRED EMBODIMENT

Figure 1:
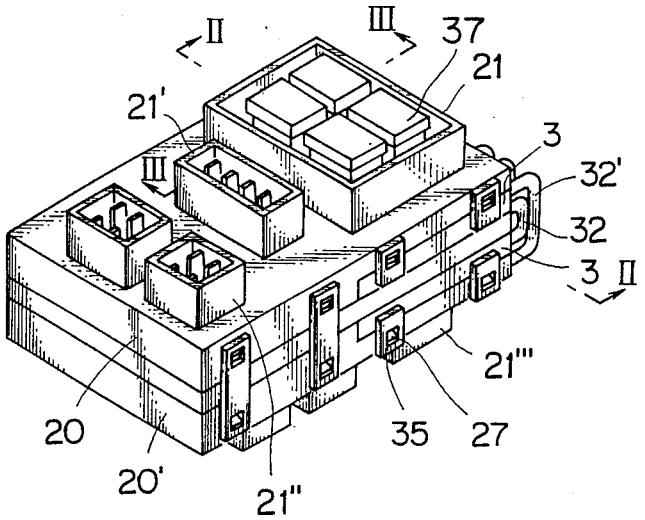
FIG. 1 is a perspective view of a junction block according to the present invention.
Figure 2:
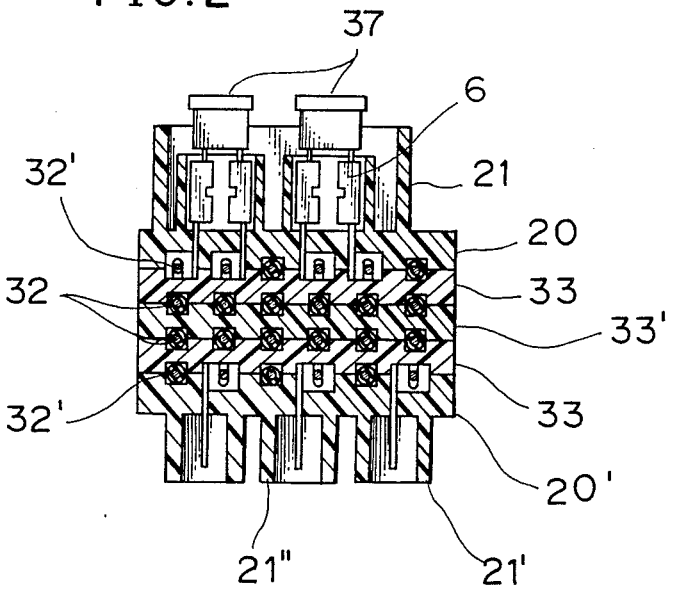
FIG. 2 is a cross-sectional view taken along the line II—II of FIG. 1.
Figure 3:
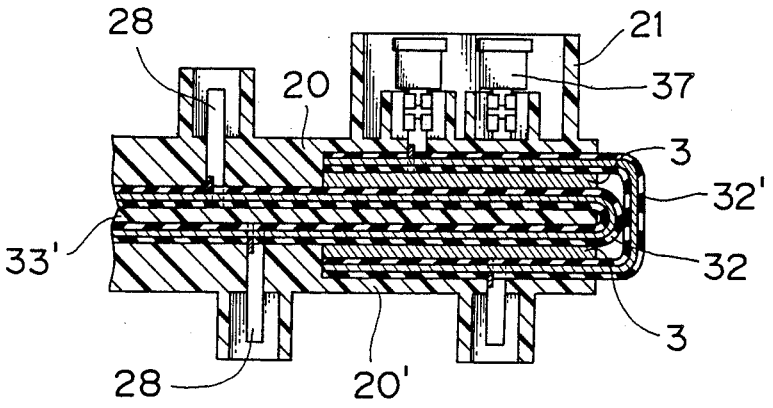
FIG. 3 is a cross-sectional view taken along the line III—III of FIG. 1.

FIG. 1 is a perspective view of a junction block according to the present invention; FIG. 2 is a cross-sectional view taken along the line II—II of FIG. 1; FIG. 3 is a cross-sectional view taken along the line III—III of FIG. 1; and FIGS. 4A–4F are diagrams for illustrating the assembly process of the junction block according to the present invention.

Figure 4A:
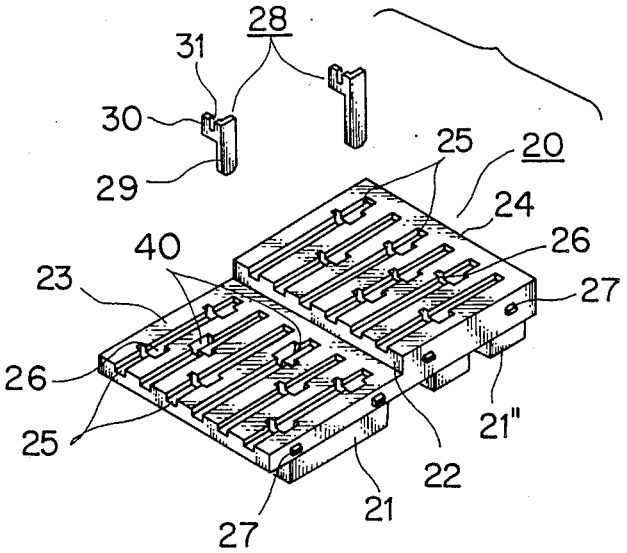
FIGS. 4A–4F are diagrams for illustrating the assembly process of the junction block according to the present invention.

Referring to these drawings, on the upper surface of cover cases 20,20' are formed connector receiving portions 21,21', 21''' . . . for receiving connectors on which external wires are assembled. On the back surface of each cover cases are formed steps 22 to define a lower stepped surface 23 and an upper stepped surface 24. Each of the stepped surfaces is provided with a plurality of conductor-receiving grooves 25 disposed side by side each of which is provided with terminal press-insertion holes 26 corresponding to the respective connector receiving portions 21,21',21''' . . . Also engaging-protrusions 27 (FIG. 4A) are provided on both longitudinal side surfaces of the upper stepped surfaces 24 and the lower stepped surfaces 23 of the cover cases 20,20'. Referring to FIG. 4A, a friction-contact terminal 28 has a male strip contact 29 on one side thereof and a friction contact portion 30 on the other side thereof. The friction contact portion 30 is provided with a wire press insertion groove 31. The male strip contact 29 is pressure-inserted into the terminal press-insertion holes 26, protruding into the respective connector receiving portions 21,21',21'' . . . The friction-contact terminals 28 may be pressed into the cover cases in different orientation at 40 as shown in FIG. 4A.

Figure 4B:
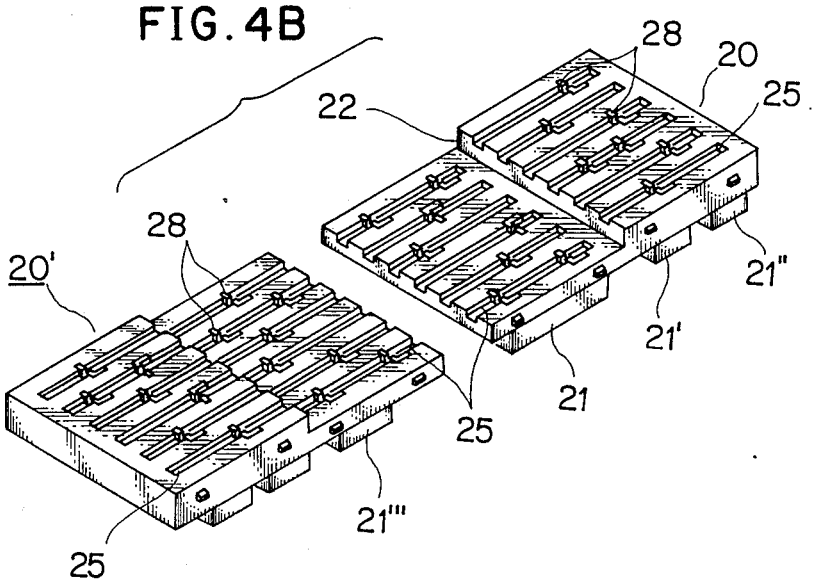

FIG. 4B shows the cover cases 20,21 into which the friction-contact terminals 28 are pressed.

Figure 4C:
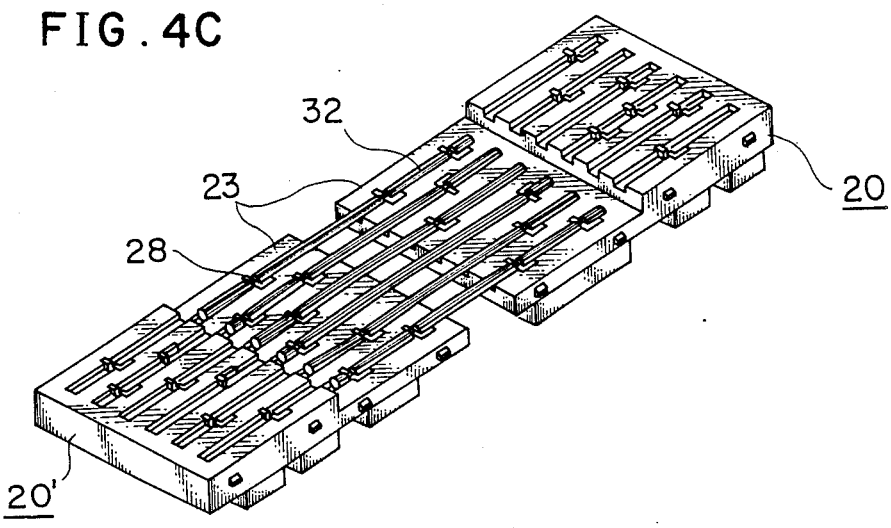

Referring to FIG. 4C, conductors 32 are, for example, insulated solid wires (copper) having a predetermined length and are disposed in the conductor-receiving grooves 25,25 on the lower stepped surface 23 of the cover cases 20,20' and then pressure-inserted into the wire press insertion grooves 31 of the friction-contact terminals 28.

On both front and rear surfaces of a first insulating partition 33 are provided conductor-receiving grooves 34 corresponding to the conductor-mounting grooves 25, and on both side surfaces of the first insulating partition 33 are provided with snap-on members 35.

Figure 4D:
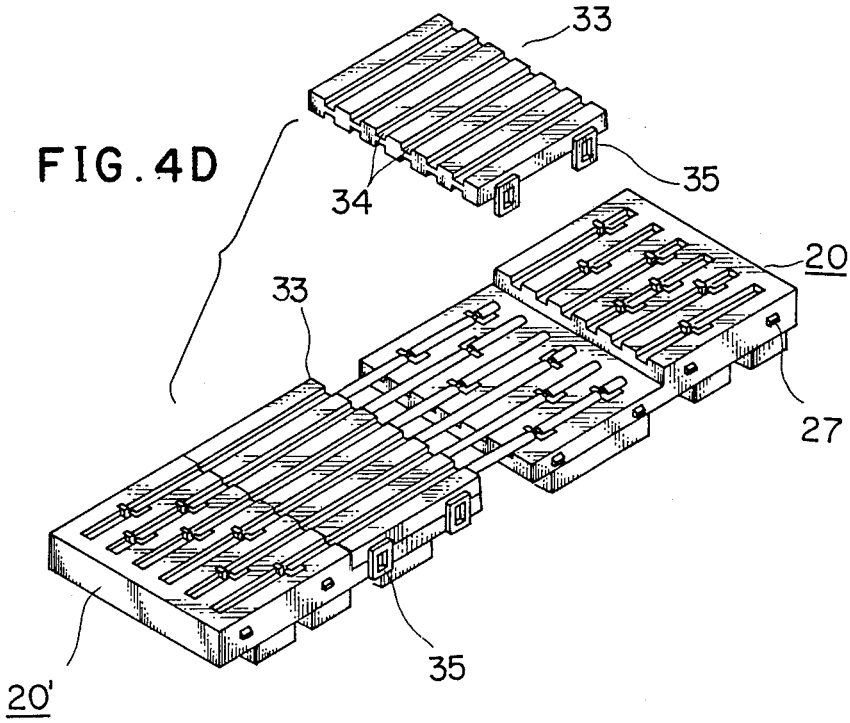
Figure 4E:
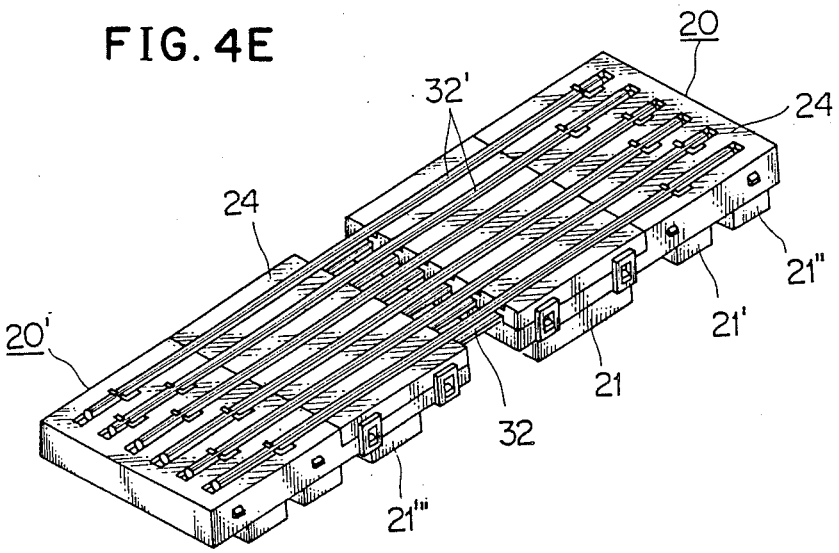

As shown in FIG. 4D, the first insulating partition 33 is placed on the lower stepped surface 23 of the cover case 20' on which the conductors 32 and the friction-contact terminals 28 are mounted through press fit connection, thereby receiving the conductors 32 between the grooves on the partition 33 and grooves on the lower stepped surface 23. Then the snap-on members 35 engage the engagement protrusions 27 through snap-on fitting, interlocking the partitions 33 and the cover cases 20,20'. Placing the insulating partition 33 on the lower stepped surface 32 makes the stepped back surfaces flat as shown in FIG. 4. Conductors 32' nearly two times longer than the conductors 32 are disposed in the conductor-receiving grooves 25 of the cover cases 20 and 20', which grooves 25,25 are aligned with each other in a straight line. The conductors 32' are press-fitted into the wire press insertion grooves 31 of the friction-contact terminals 28 for electrical connection as shown in FIG. 4E.

Figure 4F:
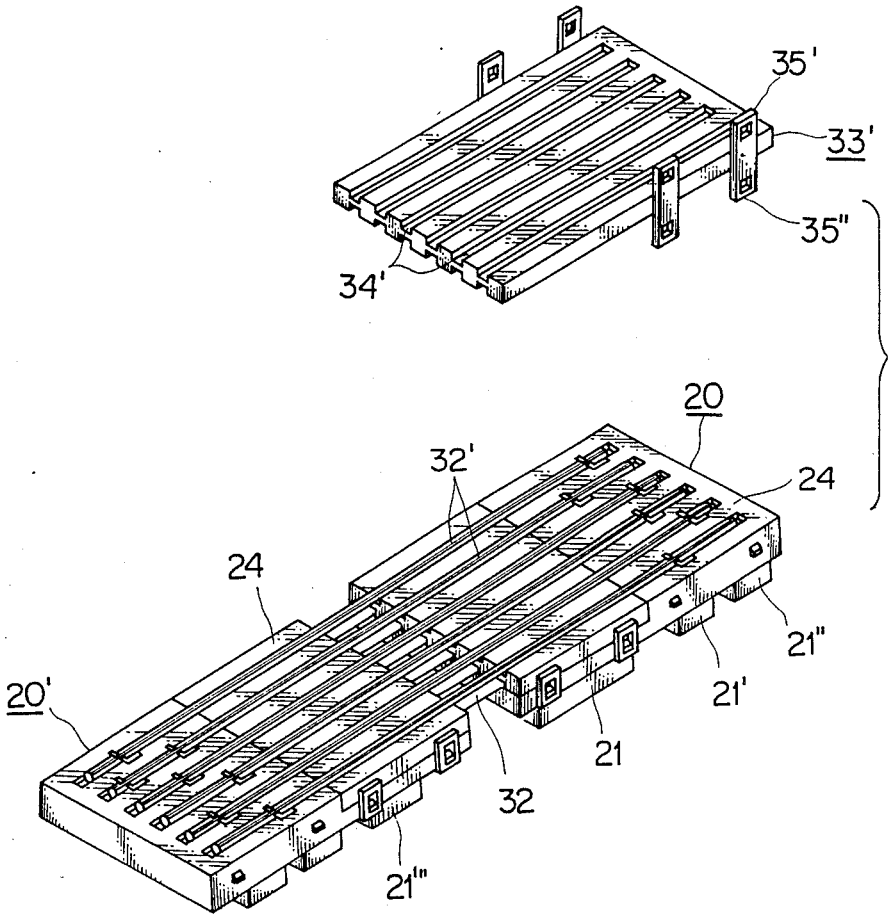
Figure 6:
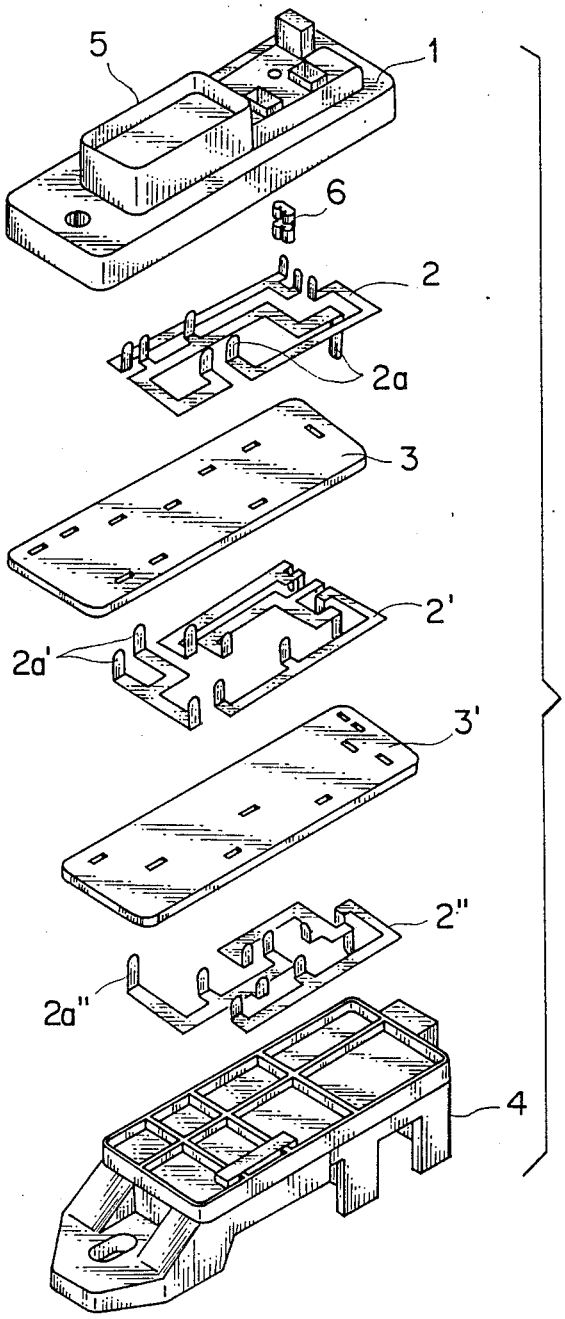
FIG. 6 PRIOR ART
FIG. 6 is an exploded perspective view of a prior art junction block.

A second insulating partition 33' of the same length as the cover case 20(20') is provided with conductor receiving grooves 34' disposed on the front and rear surfaces thereof. On both side surfaces of the insulating partition 33' are provided snap-on members 35',35'' which are protruding upwardly or downwardly as shown in FIG. 4F.

The second insulating partition 33' is placed on either the cover case 20 or the cover case 20' and then the entire assembly of the cover cases 20,20' is folded at the middle of the conductors 32,32' so as to stack one on top of the other Then the second insulating partition 33' is locked with the two cover cases 20,20' by means of the snap-on members 35',35'', thereby completing assembly of a junction block as shown in FIG. 1.

It should be noted that the tabs of the different conductors can also be electrically connected by means of U-links 37 and the relay terminals 6 as shown in FIG. 1 rather than being connected with the external circuits through the external connectors.

Figure 5:
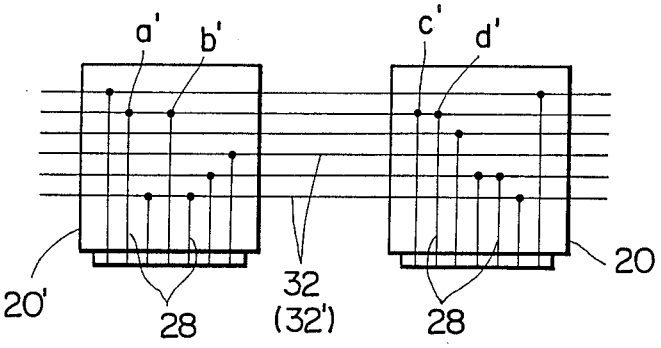
FIG. 5 is a diagram for showing an example of an electrically equivalent circuit of the junction block in FIG. 1.
Figure 9:
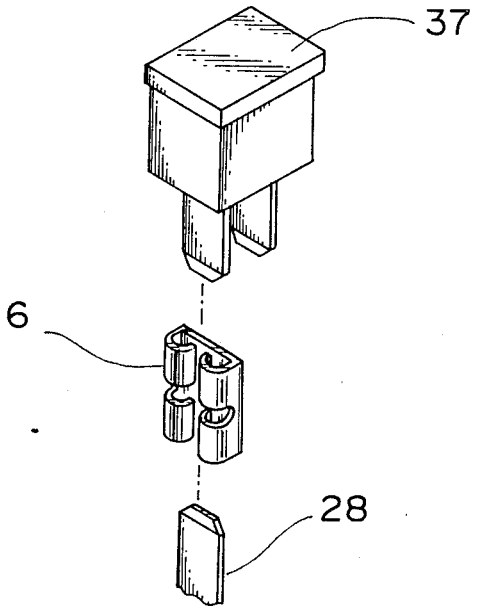
Figure 8:
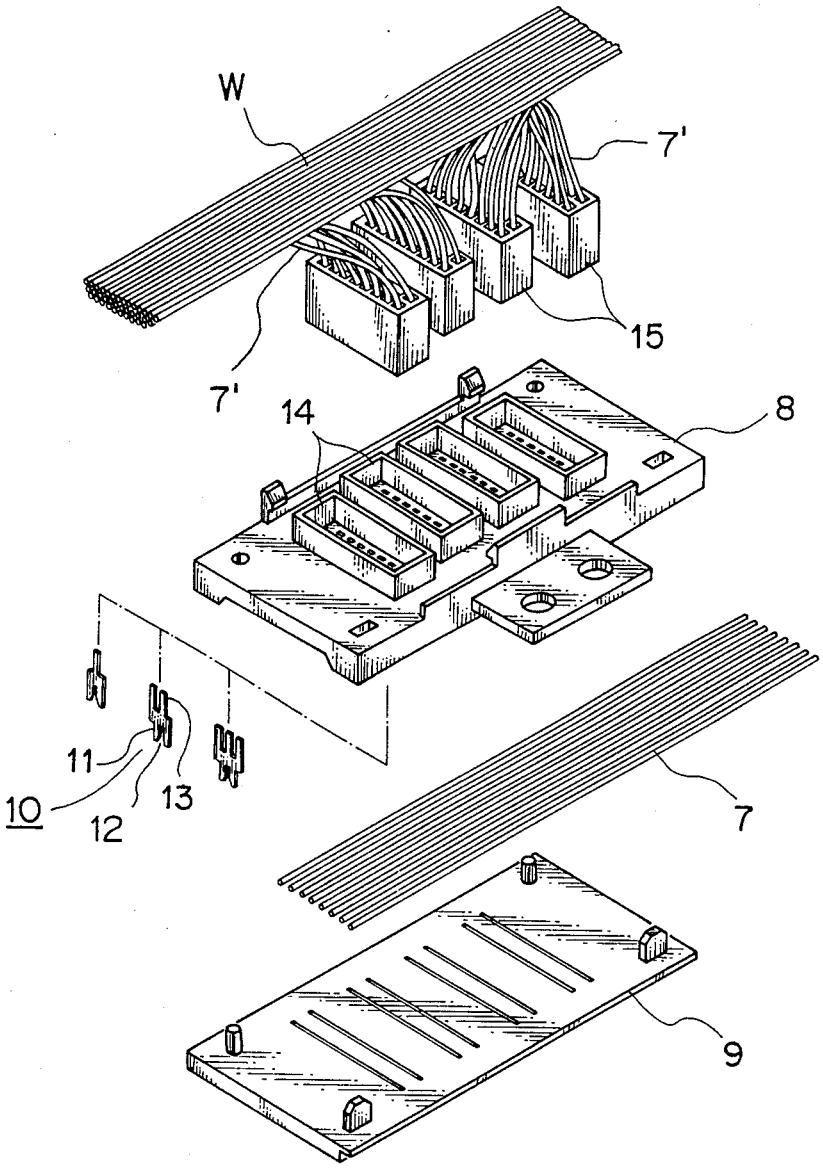
FIG. 8 PRIOR ART
FIG. 8 is an exploded perspective view of another prior art junction block.

FIG. 9 illustrates the U-link when it used to connect two friction-contact terminals through the female-female type relay terminals 6. FIG. 5 illustrates an electrically equivalent circuit of a junction block formed of the conductors 32(32') and the friction-contact terminals 28 according to the aforementioned arrangement.

Figure 7:
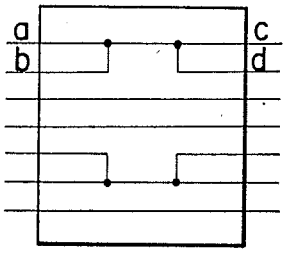
FIG. 7 PRIOR ART
FIG. 7 is a diagram for illustrating an example of an electrical equivalent circuit of FIG. 6.

As is apparent from FIG. 5, the conductors 32 (32') span two cover cases 20 and 20'; therefore the four tabs b',c',d', for example, can be grouped into the tabs a',b' on the cover 20' and the tabs c',d' on the cover 20' without difficulty, from which the prior art in FIG. 7 suffers.

The embodiment shown in FIG. 1 to FIG. 4 has been described referring to an example where the cover cases 20,20' are formed to have the steps 22 and the conductors are disposed in four levels in height but the invention may also be embodied in two levels in height. In which case, the cover cases 20,20' has no stepped surfaces but flat surfaces. Conductors 32' are disposed in the grooves 25 and press-fitted into the wire press insertion grooves 31 of the friction-contact terminals 28. Then the second insulating partition 33' as shown in FIG. 4F is placed on either the cover case 20 or the cover case 20' and then the entire assembly of the cover cases 20,20' is folded at the middle portions of the conductors 32,32' so as to stack one on top of the other, the partition 33' being sandwiched therebetween. The junction block according to the present invention is arranged in such a way that the conductors 32(32') are folded at the middle thereof and branching and connecting are made from both sides of the folded conductors; therefore the entire assembly which has a more complicated circuit configuration is simplified, thereby facilitating grouping of the branching and connecting (the connector receiving portions 21,21',21'' . . . ) the wires of the wire harness.

Also, the junction block can be assembled independently of the wire harness since the conductors 32,32' are not formed integrally with the conductive material of the wire harness but instead are formed of other independent conductors.

Unlike prior art junction blocks in which bus-bar tabs are utilized, a junction block according to the present invention is advantageous in that routing bus bars do not impair design flexibility, complicated circuits can be provided in a simplified construction, branching and connecting of wires can be effected in a wide variety of groupings, and the junction block can be assembled independently of the wire harness which is to be connected or branched through the junction block.

What is claimed is:

1. A junction block comprising:

a pair of first and second cover cases each having an inner surface and an outer surface, said inner surfaces having grooves therein;

a plurality of electrical conductors each having a first portion, a second portion, and a middle portion therebetween, said first portion of each of said conductors being received in one of said grooves of said first cover case and said second portion of each of said conductors being received in one of said grooves of said second cover case;

contact-terminals inserted through said grooves of said first and second cover cases to protrude through said outer surfaces of said first and second cover cases for electrical connection between said first or second portions of said conductors and external circuits; and insulating partitioning means, said first cover case being piled on said insulating partitioning means with said grooved inner surface of said first cover case facing a surface of said insulating partitioning means; and said second cover case being piled on said insulating partitioning means with said grooved inner surface of said second cover case facing an opposed surface of said insulating partitioning means, whereby said first and second portions of said electrical conductors are retained in said inner surface grooves of said first and second cover cases and insulated against electrical contact by said insulating partitioning means sandwiched between said first and second cover cases.

2. A junction block according to claim 1, wherein said contact-terminals being pressed into said first and second cover cases, and said contact-terminals are electrically connected with said conductors through friction-insertion.

3. A junction block comprising:

a pair of first and second cover cases with each cover case having an inner surface and an outer surface, said inner surfaces each including a lower stepped surface and an upper stepped surface and a plurality of grooves in each of said upper and lower stepped surfaces;

a plurality of electrical conductors including a first group of conductors and a second group of conductors with each conductor of each group having a first portion, a second portion and a middle portion therebetween, insulating partitioning means including two first partitions and a second partition, said first and second partitions having grooves in surfaces thereof for receiving portions of said conductors therein;

said first portions of said first group of conductors being received in said grooves of said lower stepped surface of said first cover case and said second portions of said first group of conductors being received in said grooves of said lower stepped surface of said second cover case, each of said first partitions being placed on one of said lower stepped surfaces to retain said first and second portions of said first group of conductors in said grooves of said lower stepped surfaces;

said first portions of said second group of conductors being received in said grooves of said upper stepped surface of said first cover case and said grooves in one of said first partitions and said second portions of said second group of conductors being received in said grooves of said upper stepped surface of said second cover case and said grooves in the other of said first partitions;

contact-terminals inserted through said grooves of said first and second cover cases to protrude through said outer surfaces of said first and second cover cases to provide electrical connection between one of said first or second portions of said electrical conductors and external circuits; and said first cover case and one of said first partitions is piled on a surface of said second partition and said second cover case and the other first partition is piled on an opposed surface of said second partition, whereby said insulating partitioning means is sandwiched between said first and second cover cases.

* * * * *